US011027290B2

(12) United States Patent
Hilding

(10) Patent No.: US 11,027,290 B2
(45) Date of Patent: Jun. 8, 2021

(54) CENTRIFUGAL SEPARATOR HAVING AN INTERMITTENT DISCHARGE SYSTEM WITH HYDRAULICALLY OPERATED SLIDING BOWL BOTTOM

(71) Applicant: ALFA LAVAL CORPORATE AB, Lund (SE)

(72) Inventor: Klas Hilding, Älta (SE)

(73) Assignee: ALFA LAVAL CORPORATE AB, Lund (SE)

( * ) Notice: Subject to any disclaimer, the term of this patent is extended or adjusted under 35 U.S.C. 154(b) by 388 days.

(21) Appl. No.: 16/069,003

(22) PCT Filed: Feb. 16, 2017

(86) PCT No.: PCT/EP2017/053471
§ 371 (c)(1),
(2) Date: Jul. 10, 2018

(87) PCT Pub. No.: WO2017/144339
PCT Pub. Date: Aug. 31, 2017

(65) Prior Publication Data

US 2018/0353973 A1 Dec. 13, 2018

(30) Foreign Application Priority Data

Feb. 22, 2016 (EP) ..... 16156635

(51) Int. Cl.
*B04B 1/14* (2006.01)
*B04B 11/02* (2006.01)
*B04B 11/04* (2006.01)

(52) U.S. Cl.
CPC ..... *B04B 1/14* (2013.01); *B04B 11/02* (2013.01); *B04B 11/04* (2013.01); *B04B 2011/046* (2013.01)

(58) Field of Classification Search
CPC ..... B04B 1/14; B04B 11/02; B04B 11/04; B04B 2011/046
See application file for complete search history.

(56) References Cited

U.S. PATENT DOCUMENTS 3,073,516 A 1/1963 Glasson
4,103,822 A 8/1978 Stroucken
(Continued)

FOREIGN PATENT DOCUMENTS

CN 103357516 A 10/2013
CN 104245146 A 12/2014
(Continued)

OTHER PUBLICATIONS

European Search Report, issued in Priority Application No. 16 156 635.1, dated Aug. 3, 2016.
(Continued)

*Primary Examiner* — Charles Cooley
(74) *Attorney, Agent, or Firm* — Birch, Stewart, Kolasch & Birch LLP

(57) ABSTRACT

A centrifugal separator for separation of at least two components of a fluid mixture of different densities includes a centrifuge rotor with a sliding bowl bottom movable between a closed position, in which the peripheral ports are closed, and an open position, in which the peripheral ports are open, an inlet channel for supplying hydraulic fluid to a closing chamber between the sliding bowl bottom and the rotor casing in order to hold the sliding bowl bottom in the closed position. The centrifugal separator includes at least one hermetic seal at a second end, other than the first end, of a hollow spindle and the inlet channel for supplying hydraulic fluid to the closing chamber extends through the hollow spindle and is arranged such that the hydraulic fluid
(Continued)

is in thermal contact with the at least one hermetic seal when the hydraulic fluid is supplied to the closing chamber.

20 Claims, 3 Drawing Sheets

(56) References Cited

U.S. PATENT DOCUMENTS

| | | | | |
|---|---|---|---|---|
| 4,354,632 | A | 10/1982 | Stroucken | |
| 4,401,429 | A | 8/1983 | Koslowski | |
| 4,514,183 | A | 4/1985 | Kohlstette | |
| 4,759,744 | A * | 7/1988 | Krook | B04B 1/08 494/10 |
| 5,792,037 | A | 8/1998 | Bodelson et al. | |
| 6,390,964 | B1 * | 5/2002 | Mackel | B04B 1/14 494/14 |
| 8,182,408 | B2 * | 5/2012 | Isaksson | B01D 45/14 494/70 |
| 10,514,066 | B2 * | 12/2019 | Hoglund | B04B 15/02 |
| 2009/0186752 | A1 * | 7/2009 | Isaksson | B04B 9/12 494/40 |
| 2013/0095993 | A1 | 4/2013 | Isaksson et al. | |
| 2014/0235422 | A1 * | 8/2014 | Isaksson | B04B 1/00 494/41 |
| 2018/0353973 | A1 * | 12/2018 | Hilding | B04B 11/02 |
| 2020/0016610 | A1 * | 1/2020 | Hilding | B04B 11/02 |
| 2021/0031216 | A1 * | 2/2021 | Byhmer | B04B 11/04 |

FOREIGN PATENT DOCUMENTS

| | | | |
|---|---|---|---|
| EP | 0 241 128 | A1 | 10/1987 |
| EP | 2 529 838 | A1 | 12/2012 |
| EP | 2 567 754 | A1 | 3/2013 |
| EP | 2 644 278 | A1 | 10/2013 |
| GB | 634476 | | 3/1950 |
| GB | 663141 | | 12/1951 |
| WO | WO 00/69567 | A1 | 11/2000 |

OTHER PUBLICATIONS

International Search Report, issued in PCT/EP2017/053471, dated May 17, 2017.

Written Opinion of the International Searching Authority, issued in PCT/EP2017/053471, dated May 17, 2017.

Chinese Office Action and Search Report dated Sep. 4, 2019, for corresponding Chinese Patent Application No. 201780012581.2, with English translation.

* cited by examiner

CENTRIFUGAL SEPARATOR HAVING AN INTERMITTENT DISCHARGE SYSTEM WITH HYDRAULICALLY OPERATED SLIDING BOWL BOTTOM

FIELD OF THE INVENTION

The present invention relates to the field of centrifugal separators, and more specifically to centrifugal separators having a discharge system that allows for intermittently ejecting separated sludge from a centrifuge bowl.

BACKGROUND OF THE INVENTION

Centrifugal separators are generally used for separation of liquids and/or solids from a liquid mixture. During operation, liquid mixture that is about to be separated is introduced into a rotating bowl and due to the centrifugal forces, heavy particles or denser liquid, such as water, accumulates at the periphery of the rotating bowl whereas less dense liquid accumulates closer to the central axis of rotation. This allows for collection of the separated fractions, e.g. by means of different outlets arranged at the periphery and close to the rotational axis, respectively.

In certain types of centrifugal separators, separated sludge is discharged through a number of ports in the periphery of the separator bowl. Between discharges these ports are covered by e.g. a sliding bowl bottom, which forms an internal bottom in the separating space of the bowl. Such a sliding bowl bottom may be pressed up against the upper part of the bowl to cover the ports by the force of a hydraulic fluid, such as water, underneath. In order to initiate a sludge discharge, the hydraulic fluid is drained from underneath the sliding bowl bottom so that the lifting force acting to press the sliding bowl bottom upwards is decreased, which in turn initiates a motion of the sliding bowl bottom so that the ports are opened. To close the ports again, hydraulic fluid is yet again supplied to the space underneath the sliding bowl bottom. Such hydraulically operated systems allows for opening and closing of the ports for only a fraction of a second and may result in partial or complete emptying of the content in the separation bowl.

Furthermore, the hydraulic liquid used for the opening and closing the bowl may preferably be introduced underneath the sliding bowl bottom at the smallest possible radius from the rotational axle as possible in order to have a large hydraulic pressure on the sliding bowl bottom. However, in certain type of separators the liquid that is to be separated (the feed) is introduced through a hollow spindle that supports the separator bowl and extends around the axis of rotation. There may thus be a problem of introducing the hydraulic liquid at a small radius from the rotational axis in such separators.

SUMMARY OF THE INVENTION

A main object of the present invention is to provide a centrifugal separator arranged so that it allows both the feed and the hydraulic fluid to the closing chamber to be introduced at a small radius.

As a first aspect of the invention, there is provided a centrifugal separator for separation of at least two components of a fluid mixture which are of different densities, which centrifugal separator comprises a frame, a hollow spindle rotatably supported by the frame, a centrifuge rotor mounted to a first end of the hollow spindle to rotate together with the spindle around an axis (x) of rotation, wherein the centrifuge rotor (4) comprises a rotor casing enclosing a separation space in which a stack of separation discs is arranged, a duct arranged to be through-flown by process medium during operation of the centrifugal separator and extending through the hollow spindle and in fluid contact with the separation space, at least one liquid outlet for discharging a separated liquid phase from the separation space, a plurality of peripheral ports extending from the separation space through the rotor casing to a surrounding space for discharging a phase from the periphery of the separation space, wherein the centrifuge rotor comprises a sliding bowl bottom movable between a closed position, in which the peripheral ports are closed, and an open position, in which the peripheral ports are open, an inlet channel for supplying hydraulic fluid to a closing chamber between the sliding bowl bottom and the rotor casing in order to hold the sliding bowl bottom in the closed position, wherein the centrifugal separator further comprises at least one hermetic seal at a second end, other than the first end, of the hollow spindle, characterized in that the inlet channel for supplying hydraulic fluid to the closing chamber extends through the hollow spindle and is further arranged such that the hydraulic fluid is in thermal contact with the at least one hermetic seal when the hydraulic fluid is being supplied to the closing chamber.

The centrifugal separator is for separation of a fluid mixture, such as a gas mixture or a liquid mixture. The frame of the centrifugal separator is a non-rotating part, and the hollow spindle is supported by the frame by at least one bearing device, such as by at least one ball-bearing.

The centrifuge rotor is adjoined to a first end of the hollow spindle and is thus mounted to rotate with the spindle. During operation, the spindle thus forms a rotating shaft. The first end of the spindle may be an upper end of the spindle. The hollow spindle is thus rotatable around the axis of rotation (X).

The spindle may be arranged to rotate at a speed of above 3000 rpm, such as above 3600 rpm.

The spindle may further have a diameter of at least 5 mm, such as at least 10 mm. For example, the outer diameter of the spindle may be between 5-300 mm, such as between 10-200 mm.

The centrifugal separator may of course also comprise a drive member for rotating the hollow spindle, and thereby the centrifuge rotor mounted on the spindle. Such a drive member for rotating the hollow spindle may comprise an electrical motor having a rotor and a stator. The rotor may be provided on or fixed to the spindle. Alternatively, the drive member may be provided beside the spindle and rotate the rotating part by a suitable transmission, such as a belt or a gear transmission.

The centrifuge rotor encloses by a rotor casing a separation space in which the separation of the fluid mixture takes place. The separation space comprises a stack of separation discs arranged centrally around the axis of rotation. The separation discs form surface enlarging inserts in the separation space. The separation discs may have the form of a truncated cone, i.e. the stack may a stack of frustoconical separation discs. The discs may also be axial discs arranged around the axis of rotation.

The at least one liquid outlet for fluid that has been separated may comprise a first outlet and a second outlet arranged at a larger radius from the rotational axis as compared to the first liquid outlet. Thus, liquids of different densities may be separated and be discharged via the first and second liquid outlets, respectively.

The duct arranged to be through-flown by process medium during operation is extending through the hollow spindle along the axis of rotation. The process medium may be the fluid mixture to be separated, i.e. the feed. Consequently, in embodiments of the first aspect of the invention, the duct arranged to be through-flown by process medium during operation of the centrifugal separator is a duct for the fluid mixture that is to be separated.

The process medium may also be a separated liquid phase.

Thus, the process medium may be the fluid mixture to be separated or a separated liquid phase.

Thus, the duct may be in fluid contact with the at least one liquid outlet such that a separated liquid phase is discharged through the duct. Consequently, in embodiments of the first aspect of the invention, the duct arranged to be through-flown by process medium during operation of the centrifugal separator is a duct for a separated liquid phase. In that case, the fluid mixture to be separated may be fed to the separation chamber via pipes other than the spindle. Alternatively, the hollow spindle may comprise an inlet duct for fluid mixture to be separated, a duct for separated liquid and an inlet channel for supplying hydraulic fluid to the closing chamber. These ducts may be arranged as concentric pipes in the hollow spindle.

The phase at the periphery of the separation space may be a sludge phase, i.e. mixed solid and liquid particles forming a heavy phase. Thus, the peripheral ports of the centrifuge rotor may be for separating a sludge phase. During operation, sludge is collected in an outer peripheral part of the separation space inside or immediately inside the peripheral ports.

The peripheral ports are arranged to be opened intermittently, during a short period of time in the order of milliseconds, to enable discharge of a phase, such as sludge, from the separation space to the surrounding space. This is achieved by axially moving the hydraulically operable sliding bowl bottom from a position in which it covers the peripheral ports to a position in which it does not cover the peripheral ports, and back again.

The centrifuge rotor, the bowl, may thus comprise an upper bowl part and the lower sliding bowl bottom. In the closed position, a hydraulic fluid in a closing chamber underneath the sliding bowl bottom, press the sliding bowl bottom up against the upper bowl part, such as against an annular sealing ring in the upper part of the bowl.

The hydraulic fluid is supplied via the inlet channel that extends through the hollow spindle. The hydraulic fluid may be a liquid, such as water, oil or an organic liquid. The hydraulic fluid may further be a gas.

Furthermore, the centrifugal separator comprises at least one hermetic seal. This seal is arranged at a second end of the hollow spindle, i.e. at the end opposite the end of the spindle to which the centrifuge rotor is adjoined. The hermetic seal may thus be arranged at a lower end of the spindle if the centrifuge rotor is mounted on the upper end of the spindle. The hermetic seal arranged for sealing the hollow spindle against a non-rotating member, such as against a non-rotating pipe through which the liquid mixture to be separated, the feed, is supplied to the inlet duct of the hollow spindle, or against a non-rotating pipe that is arranged for supplying the hydraulic fluid to the inlet channel.

Consequently, at least one hermetic seal may be a seal that seals against the duct arranged to be through-flown by process medium during operation of the centrifugal separator.

The bearings and drive member of the centrifugal separator may thus be arranged at a position on the hollow spindle that is between the at least one hermetic seal and the centrifuge rotor.

A hermetic seal refers to a seal that is supposed to give rise to an air tight seal between a non-rotating member and the hollow spindle, i.e. to prevent air from outside the hollow spindle to contaminate the feed. The hermetic seal may be a seal that seals the spindle against a non-rotating member, such as a pipe.

A hermetic seal connecting the spindle to the pipe for delivering the feed also allows for supplying e.g. the feed under pressure, i.e. the inlet duct and the separation space of the centrifuge rotor may be connected in a pressure communicating manner. The use of the hermetic seal may thus give a centrifugal separator having a hermetic inlet, i.e. an inlet that sealed from the surroundings of the centrifuge rotor and is arranged to be filled with fluid mixture during operation. Furthermore, the at least one outlet of the separator may also be hermetic, and may further comprise a hermetic seal at each of the liquid outlets. The centrifugal separator may thus be a fully hermetic separator having both a hermetic inlet and hermetic outlets.

Moreover, the inlet channel for hydraulic fluid extending through the hollow spindle is further arranged such that the hydraulic fluid is in thermal contact with the at least one hermetic seal when the hydraulic fluid is being supplied to the closing chamber. As an example, the inlet channel itself may be in thermal contact with the at least one hermetic seal.

The cross-sectional area of the inlet channel for the hydraulic fluid may be considerably less than the cross-sectional area of the duct arranged to be through-flown by process medium during operation.

The first aspect of the invention is thus based on the insight that the hydraulic fluid, such as water, that is used in the intermittent discharge system and for keeping the peripheral ports of the centrifugal separator closed also can be used for cooling at least one hermetic seal of the spindle. Further, having the inlet channel for the hydraulic fluid extending through the hollow spindle allows for introducing the hydraulic fluid, such as closing water, at a small radius, thereby allowing a larger force to act on the sliding bowl bottom. This also allows for using hollow spindles of larger diameter and thus a high flow rate of process medium, e.g. feed, since a large diameter of the hollow spindle still allows the hydraulic fluid to be introduced on a small radius as its inlet channel extends within the hollow spindle.

The centrifugal separator may also be arranged with means that facilitates a continuous consumption of the hydraulic fluid or a circulation of the hydraulic fluid to a heat exchange unit in order to transport away heat from the hydraulic fluid that has cooled the hermetic seal. Such means may for example comprise a through hole or a connection to the inlet channel for supplying hydraulic fluid. This may be beneficial in order to secure that the hydraulic fluid maintains its heat transferring capacity during longer periods of time, i.e. that the hydraulic fluid, such as water, is able to cool the hermetic seal during longer periods of time. This may for example be in situations when the sliding bowl bottom is to be held in its closed position during longer periods of time.

Thus, in embodiments, the separator is further comprising means that facilitates a continuous consumption of the hydraulic fluid or a circulation of the hydraulic fluid to a heat exchange unit.

In embodiments of the first aspect of the invention, at least one hermetic seal is a mechanical seal.

Thus, the hermetic seal may seal the inlet duct from the surroundings of the spindle by means of mechanical parts, and not using e.g. liquid seals such as a hydro hermetic seal. A mechanical seal usually prevents oxygen transport to a higher degree as compared to a hydro hermetic seal.

As an example, the mechanical seal may comprises a stationary part arranged to be fitted onto a non-rotating member and a rotating part arranged on the hollow spindle, wherein the inlet channel for supplying hydraulic fluid to the closing chamber is arranged such that the hydraulic fluid is in thermal contact with the interface between the stationary part and the rotating part of the mechanical seal when the hydraulic fluid is being supplied to the closing chamber.

The rotating part is thus arranged to rotate with the spindle during operation, whereas the stationary part is arranged to stand still during operation. The stationary part may thus be fitted onto a non-rotating member. The rotating part may comprise a wear ring arranged around the spindle and the stationary part may comprise a seal ring and a spring that pushes the seal ring against the rotating part, e.g. so that it abuts the wear ring. At the interface between the stationary part and the rotating part a liquid seal film may be formed, e.g. between the wear ring and the seal ring. The inlet channel for supplying hydraulic fluid may thus be arranged so that it cools the interface between the rotating part and the non-rotating part as hydraulic fluid is supplied to the separator.

In embodiments of the first aspect of the invention, the separator comprises a single hermetic seal. However, the separator may also comprise more than one hermetic seal, such as two hermetic seals. Thus, in embodiments of the first aspect of the invention the separator comprises a first hermetic seal at the second end of the spindle, which first hermetic seal is arranged for sealing against a first stationary pipe that is in fluid contact with the duct of the hollow spindle that is arranged to be through-flown by process medium during operation, and a second seal for sealing against a second stationary pipe arranged for supplying the hydraulic fluid to the inlet channel of the hollow spindle.

The first stationary pipe may be a pipe for feeding fluid mixture to be separated to the duct in the spindle. The first stationary pipe may also be a pipe for receiving a separated liquid phase from the duct of the spindle. This depends on the design of the separator, i.e. whether the spindle is used for feeding the fluid mixture to be separated, for receiving a discharged liquid phase, or both.

The first hermetic seal may be a mechanical seal having a stationary part and a rotating part as discussed above. Thus, the first hermetic seal may have a stationary part arranged to be fitted onto the stationary pipe that is in fluid contact with the duct of the hollow spindle that is arranged to be through-flown by process medium during operation and a rotating part arranged on the hollow spindle.

The second seal may be any other type of seal, such as a liquid seal.

As an example, the second seal is a second hermetic seal. The second hermetic seal may thus be a mechanical seal having a stationary part and a rotating part as discussed above.

If also the second seal, i.e. the seal against the pipe for supplying hydraulic fluid, is a mechanical hermetic seal, it allows also for the hydraulic fluid to be supplied under pressure. This is advantageous in that it may prevent the hydraulic fluid to be evaporated during operation since the risk for evaporation decreases. Furthermore, supplying the hydraulic medium under pressure allows for exerting a larger lifting force on the sliding bowl bottom, and also for varying the force by varying the pressure under which the hydraulic medium is supplied.

Consequently, in embodiments of the first aspect of the invention, the separator further comprises pressure generating means arranged for supplying the hydraulic fluid under a pressure that is higher than atmospheric pressure.

The pressure generating means may comprise a pump. If the hydraulic fluid is water, the pressure may also be supplied as the pressure from the water tap, i.e. the water pressure supplied to the property in which the centrifugal separator is located.

Furthermore, the inlet channel for supplying hydraulic fluid to the closing chamber is arranged such that the hydraulic fluid is in thermal contact with the first hermetic seal and the second hermetic seal when the hydraulic fluid is being supplied to the closing chamber.

However, the inlet channel for supplying hydraulic fluid to the closing chamber may also only be in thermal contact with only one of the hermetic seals.

In embodiments of the first aspect of the invention, the inlet channel for supplying hydraulic fluid is arranged in the hollow spindle as an annular space surrounding the duct arranged to be through-flown by process medium during operation of the centrifugal separator.

The hollow spindle may thus comprise at least two axially extending concentric pipes, wherein the inner pipe is the inlet duct for liquid mixture to be separated and an outer one is the inlet channel for hydraulic fluid. In other words, the hollow spindle may the define a central inlet duct extending along the axis of rotation (x) and arranged to be through-flown by process medium during operation of the centrifugal separator and further define an annular outer space arranged radially outside the central inner duct, wherein the annular outer space is the inlet channel for supplying hydraulic fluid. The inner wall of the spindle may form a wall of the annular outer space.

In embodiments of the first aspect of the invention, the inlet channel for supplying hydraulic fluid is arranged in the hollow spindle as a pipe extending in the duct arranged to be through-flown by process medium during operation of the centrifugal separator for feeding the fluid mixture into the separation space.

Consequently, the hollow spindle may comprise at least two axially extending concentric pipes, wherein the inner pipe is the inlet channel for hydraulic fluid and the outer one is the inlet duct for liquid mixture to be separated. Thus, the inlet duct for the liquid mixture to be separated may surround the inlet channel for the hydraulic fluid.

In embodiments of the first aspect of the invention, the separator further comprises a duct through the rotor casing for supply of liquid to open at least one outlet passage through which the hydraulic fluid of the closing chamber is drained, thereby initiating moving of the sliding bowl bottom to the open position.

Thus, to initiate opening of the peripheral ports, liquid, such as water, may be supplied through the rotor casing to e.g. an opening chamber located underneath the closing chamber. The supply of opening water may initiate opening of at least one outlet passage that is provided for discharging an outlet flow of the hydraulic fluid from the closing chamber in order to move the valve slide to the open position. The outlet passage may comprise a number of outlet channels for the outlet flow.

The opening chamber may be located axially below the closing chamber. The opening chamber may comprise an annular operating slide extending around the axis of rotation and being movable from a first position to a second position upon supply of liquid to the opening channel. Movement of the operating slide from a first to a second position may open at least one valve in the at least one outlet passage.

As an example, the duct through the rotor casing for supply of liquid to open at least one outlet passage may be other than the inlet channel for supplying hydraulic fluid to the closing chamber.

Moreover, the centrifugal separator may comprise a tank for hydraulic fluid and means for delivering hydraulic fluid to the inlet channel for hydraulic fluid. Such means may be pipes and a pump for transporting hydraulic fluid from the tank to the inlet channel.

As a second aspect of the invention, there is provided a method for separation of at least two components of a fluid mixture which are of different densities, comprising

- providing a centrifugal separator according to the first aspect of the invention,
- supplying hydraulic fluid into the inlet channel to the closing chamber between the sliding bowl bottom and the rotor casing in order to hold the sliding bowl bottom in the closed position, and
- feeding the fluid mixture to be separated to the separation space of the centrifuge rotor via the duct arranged to be through-flown by process medium during operation of the centrifugal separator.

The terms and definitions used in relation to the second aspect are the same as discussed in relation to the first aspect above.

The fluid mixture to be separated may be a liquid mixture.

Depending on the application, the liquid mixture to be separated may have different temperature. As an example, the liquid mixture supplied to the separator may be supplied at room temperature. As a further example, the liquid mixture may have a temperature of at least 90° C., such as at least 95° C., such as at least 98° C. In certain applications, the liquid mixture supplied to the separator may have a temperature of below 10° C., such as below 5° C., such as below 0° C.

In embodiments of the second aspect of the invention, the hydraulic fluid is water. In embodiments of the second aspect of the invention the hydraulic fluid is supplied under pressure via the second end of the spindle.

DETAILED DESCRIPTION

The centrifugal separator according to the present disclosure will be further illustrated by the following description of an embodiment with reference to the accompanying drawings.

Figures 1A, 1B:
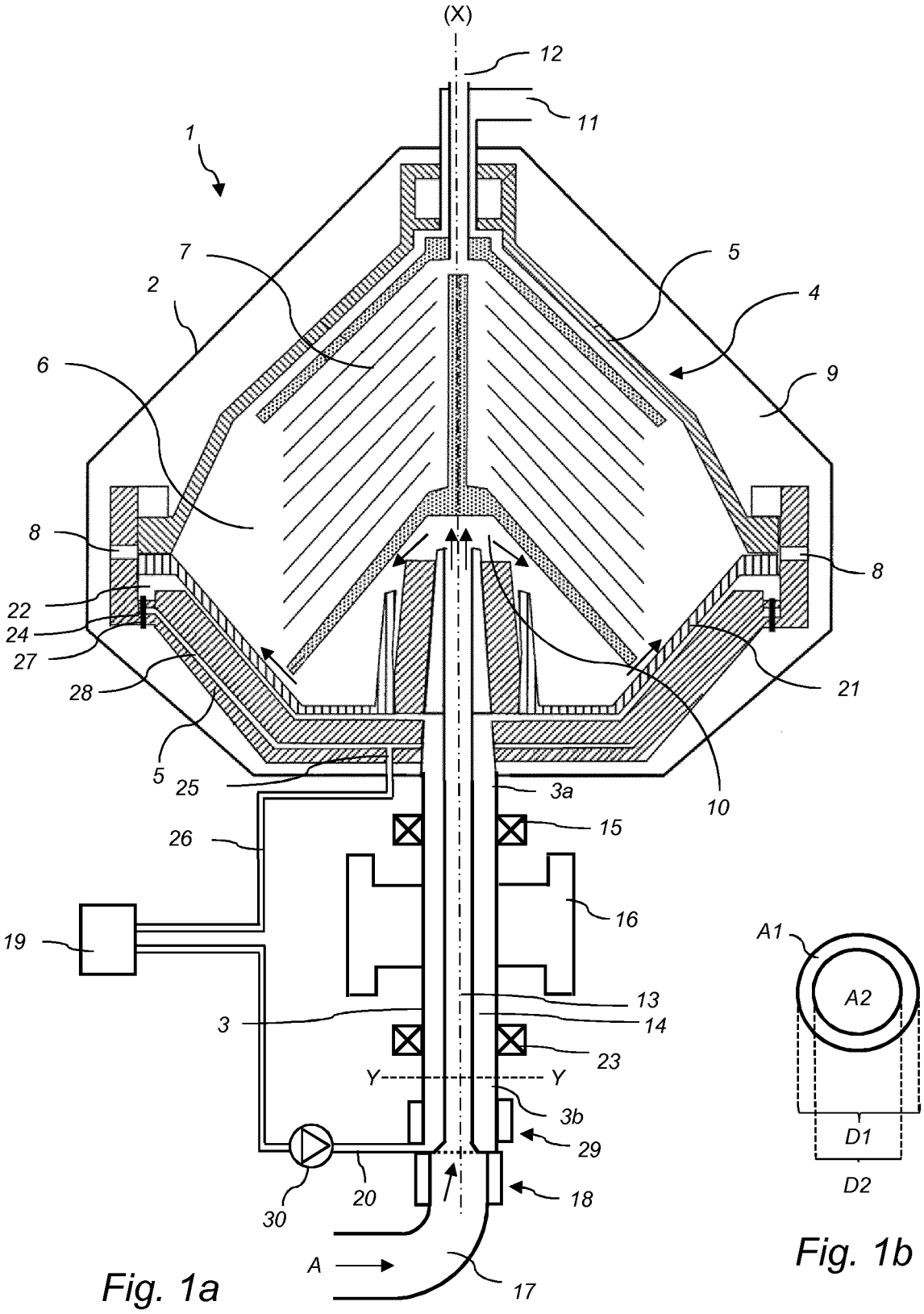
FIG. 1*a* shows a schematic drawing of a section of an embodiment of a centrifugal separator of the present disclosure.
FIG. 1*b* shows a section of the hollow spindle of the centrifugal separator of FIG. 1*a*.

FIG. 1*a* shows a centrifugal separator 1 for separating a liquid mixture. The separator comprises a frame 2, a hollow spindle 3, which is rotatably supported by the frame 2 in a bottom bearing 23 and a top bearing 15, and a centrifuge rotor 4 mounted to a top of the hollow spindle 3. The centrifuge rotor 4 is adjoined to the upper end 3*a* of the spindle 3 to rotate together with the spindle 3 around an axis (X) of rotation. The centrifuge rotor 4 comprises a rotor casing 5 enclosing a separation space 6 in which a stack 7 of separation discs is arranged in order to achieve effective separation of the liquid mixture that is separated. The separation discs of the stack 7 have a frustoconical shape and are examples of surface-enlarging inserts. The stack 7 is fitted centrally and coaxially with the rotor and the discs of the stack 7 may comprise through holes (not shown) which form channels for axial flow of liquid when the separation discs are fitted in the centrifugal separator 1. In FIG. 1*a*, only a few discs are shown. The stack 7 may for example contain above 100 discs, such as above 200 discs.

The rotor 3 has extending from it a liquid light phase outlet 12 for a lower density component separated from the liquid mixture, and a liquid heavy phase outlet 11 for a higher density component, or heavy phase, separated from the liquid mixture. The outlets 11 and 12 extend through the frame 2. In certain applications, the separator 1 only contains a single liquid outlet, such as only liquid outlet 12. This depends on the liquid material that is to be processed. The rotor 4 is further provided with a plurality of peripheral ports 8 that extend from the separation space 6 through the rotor casing 5 to a surrounding space 9 outside the centrifuge rotor 4. The peripheral ports 8 may be intermittently openable during a short time period, e.g. in the order of milliseconds, and permit total or partial discharge of sludge from the separation space as will be explained below.

The centrifugal separator 1 is further provided with a drive motor 16. This motor 16 may for example comprise a stationary element and a rotatable element, which rotatable element surrounds and is connected to the spindle 3 such that it transmits driving torque to the spindle 3 and hence to the rotor 4 during operation. The drive motor 16 may be an electric motor. Furthermore, the drive motor 16 may be connected to the spindle 3 by transmission means. The transmission means may be in the form of a worm gear which comprises a pinion and an element connected to the spindle 3 in order to receive driving torque. The transmission means may alternatively take the form of a propeller shaft, drive belts or the like, and the drive motor may alternatively be connected directly to the spindle.

A central duct 13 extends from a bottom of the hollow spindle 3 through the hollow spindle 3, which takes the form of a hollow, tubular member. The central duct 13 forms in this embodiment an inlet duct for supplying the liquid mixture for centrifugal separation to the separation space 6 via the inlet 10 of the rotor 4. Introducing the liquid material from the bottom provides a gentle acceleration of the liquid material. The spindle 3 is further connected to a stationary inlet pipe 17 at the bottom end 3*b* of the separator 1, such that liquid material to be separated may be transported to the central duct 13, e.g. by means of a pump.

A first mechanical hermetic seal 18 is arranged at the bottom end 3*b* to seal the hollow spindle 3 to the stationary inlet pipe 17. The hermetic seal 18 is an annular seal that surrounds the bottom end 3*b* of the spindle 3 and the stationary pipe 17. There is also a second mechanical hermetic seal 29 that seals the bottom end 3*b* of the spindle to a stationary pipe 20 for supply of hydraulic fluid, such as water, to the annular inlet channel 14 of the spindle 3. The hermetic seals of FIG. 1*a* are shown in more detail in FIG. 3 and are further described below.

During operation of the separator in FIG. 1*a*, the rotor 4 is caused to rotate by torque transmitted from the drive motor 16 to the spindle 3. Via the central duct 13 of the spindle 3, liquid material to be separated is brought into the separation space 6 via inlet 10. In the hermetic type of inlet 10, the acceleration of the liquid material is initiated at a small radius and is gradually increased while the liquid leaves the inlet and enters the separation space 6. Further, the separator 1 may also have a hermetic outlet and the separation space 6 may be intended to be completely filled with liquid during operation. In principle, this means that preferably no air or free liquid surfaces is meant to be present within the rotor 4. However, liquid may also be introduced when the rotor is already running at its operational speed. Liquid material may thus be continuously introduced into the rotor 4.

The path of the liquid material to be separated through the spindle 3 to the separation space 6 is illustrated by arrows "A" in FIG. 1*a*.

Depending on the density, different phases in the liquid is separated between the separation discs of the stack 7 fitted in the separation space 6. Heavier components in the liquid move radially outwards between the separation discs, whereas the phase of lowest density moves radially inwards between the separation discs and is forced through outlet 12 arranged at the radial innermost level in the separator. The liquid of higher density is instead forced out through outlet 11 that is at a radial distance that is larger than the radial level of outlet 12. Thus, during separation, an interphase between the liquid of lower density and the liquid of higher density is formed in the separation space 6. Solids, or sludge, accumulate at the periphery of the separation space 6 and may be emptied intermittently from the separation space by opening of sludge outlets, i.e. the peripheral ports 8, whereupon sludge and a certain amount of liquid is discharged from the separation space by means of centrifugal force.

The opening and closing of the peripheral ports 8 is controlled by means of a sliding bowl bottom 21 which is movable between a closed position, shown in FIG. 1*a*, in which the peripheral ports 8 are closed, and an open position, in which the peripheral ports 8 are open. The sliding bowl bottom 21 is movable between the open and closed position along a direction parallel to the axis of rotation. The sliding bowl bottom 21 may be of a rigid type that is movable as a whole between the open position and the closed position along the direction parallel to the axis of rotation. Such a sliding bowl bottom is for example disclosed in U.S. Pat. No. 4,514,183. However, the sliding bowl bottom 21 may also be of a flexible kind, wherein an inner end of the sliding bowl bottom is fixedly attached to the rotor casing and the outer end of the sliding bowl bottom 21 is moveable. Such a sliding bowl bottom 21 is for example disclosed in U.S. Pat. No. 5,792,037.

A closing chamber 22 is provided between the sliding bowl bottom 21 and the rotor casing 5. During operation, the closing chamber 22 may contain the hydraulic fluid, such as water, acting on the sliding bowl bottom 21. An inlet channel 14 extends through the hollow spindle 3 as an annular channel surrounding the central duct 13 and is configured for supplying the hydraulic fluid to the closing chamber 22 in order to hold the sliding bowl bottom 21 in the closed position. The hydraulic fluid is supplied under pressure to the inlet channel 14 from tank 19 via pipe 20 by means of pump 30. When passing the first hermetic seal 18 and the second hermetic seal 29, the hydraulic fluid is in thermal contact with the seals. Thus, the first and second hermetic seals 18, 29 are cooled as hydraulic fluid is supplied via the inlet channel 14 to the closing chamber 22. This is further shown in FIG. 3.

An outlet passage 27 comprising drainage nozzles 24 for draining the hydraulic fluid from the closing chamber 22 is provided in order to move the sliding bowl bottom 21 to the open position, thereby permitting discharge of the sludge. The draining of the hydraulic fluid from closing chamber 22 is initiated by introducing liquid, such as water, to a duct 25 through the casing for opening at least one outlet passage 27. Such water is hereinafter called "opening water". The duct 25 terminates in an opening channel 28 located axially below the closing chamber. The opening channel 28 may comprise an annular operating slide (not shown) extending around the axis of rotation and being movable from a first position to a second position upon supply of opening water to the opening channel 28. The annular operating slide may be located in the opening channel 28 axially below the closing chamber 22. Moving the operating slide to the second position may initiate opening of drainage nozzles 24 located in the outlet passages 27, thereby starting the drainage of the hydraulic fluid from the closing chamber 22. This will in turn cause the sliding bowl bottom 21 to move to its lower position so that sludge is discharged through peripheral ports 8.

When the hydraulic fluid has been drained from the closing chamber 22, the annular operating slide moves to its first position, thereby closing drainage nozzles 24, and the sliding bowl bottom 21 is raised to its closed position upon further supply of hydraulic fluid to the closing chamber 22.

The hydraulic fluid to the closing chamber 22 may be supplied at a high pressure, e.g. higher as compared to the supply of liquid to the opening channel 21, so that the sliding bowl bottom 21 may move to its closed position quickly after discharge of the sludge through peripheral ports 8.

In the embodiment shown in FIG. 1*a*, the liquid to the opening channel 28 is provided from the same tank 19 as the liquid to the closing chamber 22. However, liquid to the opening channel 28 is provided from the tank 19 using a pipe 26 that extends through the casing 5 to the opening channel 28. This pipe 26 is other than the pipe 20 which is for supplying hydraulic liquid to the inlet channel 14.

In the embodiment of FIG. 1*a*, the material to be separated is introduced via the central duct 13 of the spindle 3. However, the central duct 13 may also be used for with-drawing e.g. the liquid light phase and/or the liquid heavy phase. Thus, in embodiments, the central duct 13 comprises at least one additional duct, i.e. at least three ducts. In this way, the liquid mixture to be separated may be introduced to the rotor 4 via the central duct 13, and concurrently, the liquid light phase and/or the liquid heavy phase may be withdrawn through such an additional duct extending in the central duct 13.

FIG. 1*a* is a schematic drawing and is thus not drawn into scale. FIG. 1*b* is a cross-section of the spindle 3 of FIG. 1*a* along line Y. The total diameter D1 of the spindle may be 5-300 mm, such as 10-200 mm, and the central inner duct may have a diameter D2 such that D2 has a length that is more than half of D1, such as more than 75% of the length of D1. Thus, the cross-sectional area A1 of the inlet channel for the hydraulic fluid 14 is considerably less than the cross-sectional area A2 of the inlet duct for the feed 13.

Figures 2A, 2B:
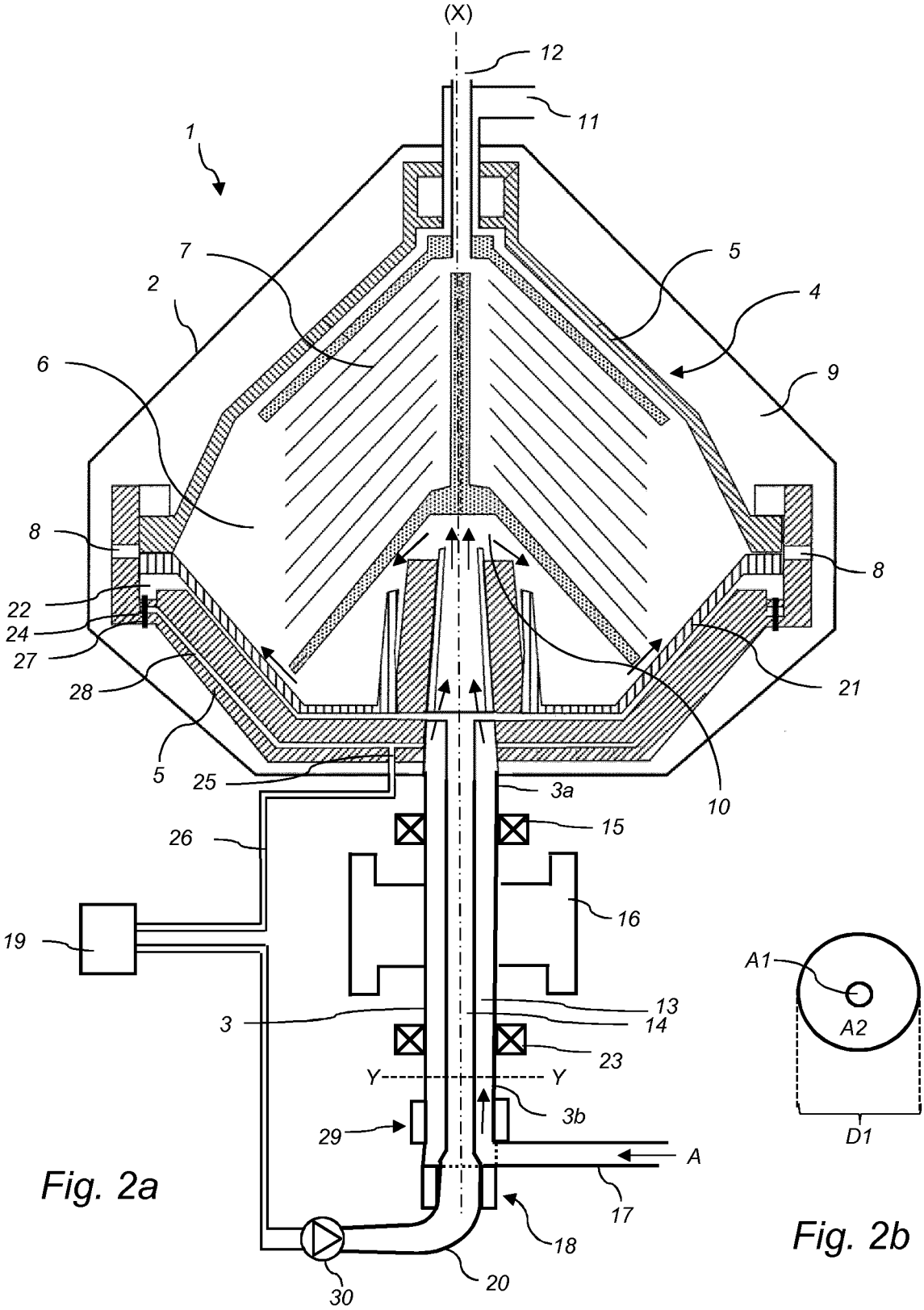
FIG. 2*a* shows a schematic drawing of a section of an embodiment of a centrifugal separator of the present disclosure.
FIG. 2*b* shows a section of the hollow spindle of the centrifugal separator of FIG. 2*a*.

FIG. 2*a* shows a schematic drawing of centrifugal separator according to another embodiment of the invention. The separator 1 is almost identical to the separator as shown in FIG. 1*a*, but with the difference that the inlet channel 14 for hydraulic fluid extends in the hollow spindle 3 as a central pipe, whereas the inlet duct 13 for liquid mixture to be separated extends as an annular chamber surrounding the inlet channel 14. Thus, the hollow spindle 3 is similar to the spindle 3 as shown in FIG. 1*a*, i.e. it is in the form of two concentric pipes, but the hydraulic fluid is, after having cooled the hermetic seal 18, instead led through the inner pipe and the feed is led through the outer pipe.

FIG. 2*a* is a schematic drawing and is thus not drawn into scale. FIG. 2*b* is a cross-section of the spindle 3 of FIG. 2*a* along line Y. The cross-sectional area A1 of the inlet channel for the hydraulic fluid 14 is considerably less than the cross-sectional area A2 of the inlet duct for the feed 13, in analogy with the embodiments shown in FIGS. 1*a* and 1*b*. The diameter D1 of the whole spindle 3 in FIGS. 2*a* and 2*b* may be 5-300 mm, such as 10-200 mm.

Figure 3:
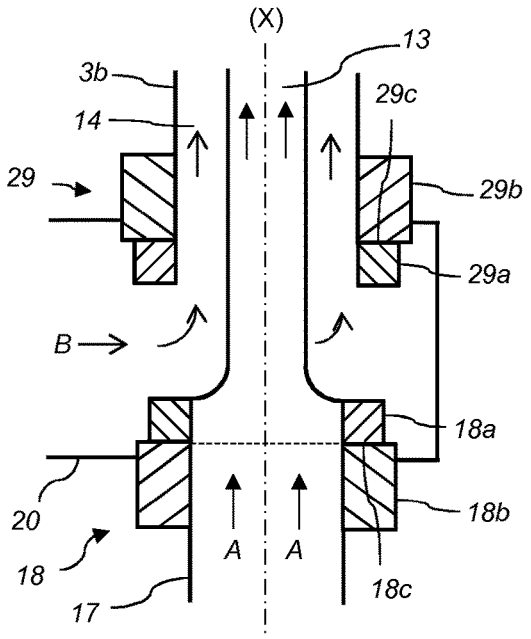
FIG. 3 shows a schematic drawing of a close-up view of the lower end of the spindle of the separator of FIG. 1*a*.

FIG. 3 shows a close-up view of the lower end 3*b* of the spindle 3 of the centrifugal separator as shown in FIG. 1*a*. As seen in FIG. 3, there is a first mechanical hermetic seal 18 that seals the lower part of the hollow spindle 3*b* to stationary pipe 17 that supplies the liquid mixture to be separated, indicated by arrows "A", to the duct 13 of the spindle. The first hermetic seal 18 comprises a rotating part 18*a* attached on the lower end of the spindle 3*b*, and a stationary part 18*b* attached to the stationary pipe 17. There is also a second mechanical hermetic seal 29 that seals the lower part of the hollow spindle 3*b* to stationary pipe 20 that supplies the hydraulic fluid to inlet channel 14 (indicated by arrows "B"). The second hermetic seal 29 comprises a rotating part 29*a* attached on the lower end of the spindle 3*b*, and a stationary part 29*b* attached to the stationary pipe 20. Thus, during operation and rotation of the centrifuge rotor, the lower end 3*b* of the spindle and the rotating parts 29*a* and 18*a* of the hermetic seals 29 and 18 rotate, whereas inlet pipes 17 and 20, as well as the stationary parts 29*b* and 18*b* of the hermetic seals 29 and 18 stand still. Upon supply of hydraulic fluid to the closing chamber 20 of the centrifugal separator via inlet channel 14 of the spindle, both the interface 18*c* between the rotating part 18*a* and the stationary part 18*b* of the first hermetic seal and the interface 29*c* between the rotating part 29*a* and the stationary part 29*b* of the second hermetic seal are cooled.

Figure 4:
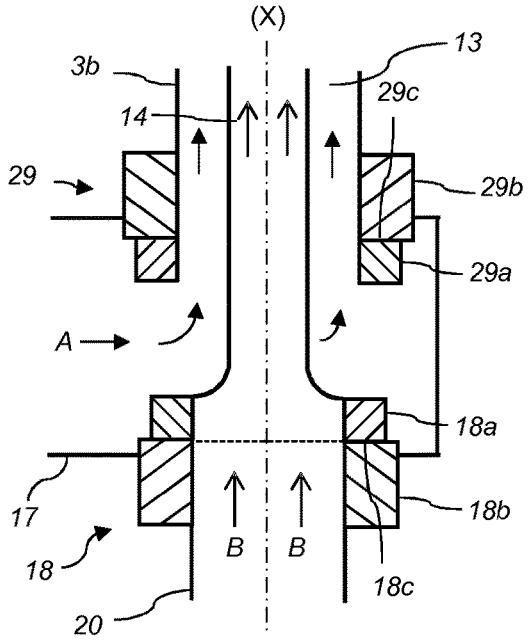
FIG. 4 shows a schematic drawing of a close-up view of the lower end of the spindle of the separator of FIG. 2.

FIG. 4 shows a close-up view of the lower end 3*b* of the spindle 3 of the centrifugal separator as shown in FIG. 2*a*. As described in relation to FIG. 2*a*, the liquid mixture that is to be separated, indicated by arrows "A", is supplied via the radially outermost channel whereas the hydraulic fluid, indicated by arrows "B", is supplied via the central channel. In other words, the duct 13 is arranged radially outside the inlet channel 14. The first mechanical hermetic seal 18 seals the spindle against stationary pipe 20, whereas the second mechanical hermetic seal 29 seals the spindle against stationary pipe 17. Upon supply of hydraulic fluid to the closing chamber 20 of the centrifugal separator via inlet channel 14 of the spindle, the interface 18*c* between the rotating part 18*a* and the stationary part 18*b* of the first hermetic seal is cooled.

Figure 5:
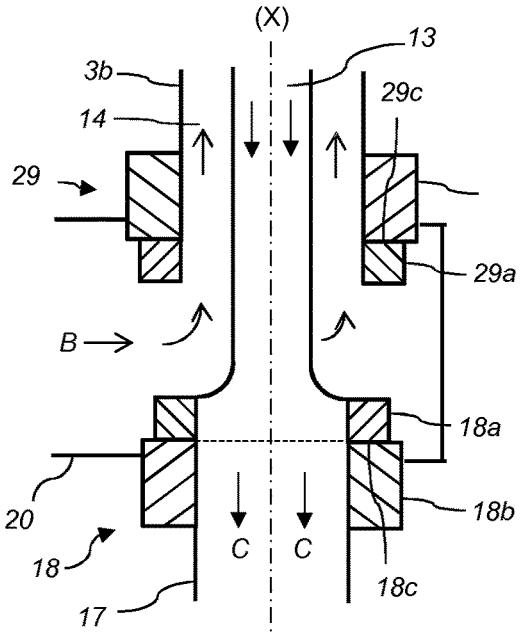
FIG. 5 shows a schematic drawing of a close-up view of the lower end of the spindle of an embodiment of a separator in which a separated liquid phase is discharged via the spindle.

FIG. 5 shows a close-up view of the lower end 3*b* of the spindle 3 of a centrifugal separator in which a separated liquid phase, indicated by arrows "C" is discharged via the duct 13 of the spindle. The duct 13 is in this embodiment arranged as a central duct in the spindle and the inlet channel 14 for supply of hydraulic fluid is arranged as annular space surrounding the duct 13. As in the embodiment shown in FIG. 3, both the interface 18*c* between the rotating part 18*a* and the stationary part 18*b* of the first hermetic seal and the interface 29*c* between the rotating part 29*a* and the stationary part 29*b* of the second hermetic seal are cooled upon supply of hydraulic fluid to the closing chamber 20 of the centrifugal separator via inlet channel 14 of the spindle.

Figure 6:
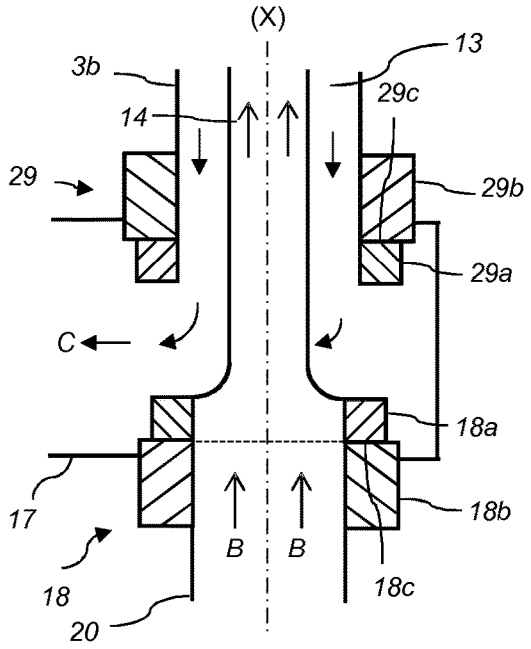
FIG. 6 shows a schematic drawing of a close-up view of the lower end of the spindle of another embodiment of a separator in which a separated liquid phase is discharged via the spindle.

FIG. 6 shows a close-up view of the lower end 3*b* of the spindle 3 of a centrifugal separator in which a separated liquid phase, indicated by arrows "C" is discharged via the duct 13 of the spindle. The duct 13 is in this embodiment arranged as an annular space surrounding the inlet channel 14 for supply of hydraulic fluid. The inlet channel 14 thus forms a central duct of the spindle. As in the embodiment shown in FIG. 4, the interface 18*c* between the rotating part 18*a* and the stationary part 18*b* of the first hermetic seal is cooled upon supply of hydraulic fluid to the closing chamber 20 of the centrifugal separator via inlet channel 14 of the spindle.

The invention is not limited to the embodiment disclosed but may be varied and modified within the scope of the claims set out below. The invention is not limited to the orientation of the axis of rotation (X) disclosed in the figures. The term "centrifugal separator" also comprises centrifugal separators with a substantially horizontally oriented axis of rotation.

The invention claimed is:

1. A centrifugal separator for separation of at least two components of a fluid mixture which are of different densities, said centrifugal separator comprising:

a frame;

a hollow spindle rotatably supported by the frame;

a centrifuge rotor mounted to a first end of the hollow spindle to rotate together with the hollow spindle around an axis of rotation, wherein the centrifuge rotor comprises a rotor casing enclosing a separation space in which a stack of separation discs is arranged;

a duct arranged to be through-flown by process medium during operation of the centrifugal separator and extending through said hollow spindle and in fluid contact with said separation space;

at least one liquid outlet for discharging a separated liquid phase from said separation space; and a plurality of peripheral ports extending from the separation space through the rotor casing to a surrounding space for discharging a phase from the periphery of said separation space, wherein said centrifuge rotor comprises:

a sliding bowl bottom movable between a closed position, in which the peripheral ports are closed, and an open position, in which the peripheral ports are open; and an inlet channel for supplying hydraulic fluid to a closing chamber between the sliding bowl bottom and the rotor casing in order to hold the sliding bowl bottom in the closed position, wherein the centrifugal separator further comprises at least one hermetic seal at a second end, other than the first end, of the hollow spindle, and wherein said inlet channel for supplying hydraulic fluid to said closing chamber extends through the hollow spindle and is further arranged such that said hydraulic fluid is in thermal contact with said at least one hermetic seal when said hydraulic fluid is being supplied to said closing chamber.

2. The centrifugal separator according to claim 1, wherein said at least one hermetic seal is a mechanical seal.

3. The centrifugal separator according to claim 2, wherein the mechanical seal comprises:

a stationary part arranged to be fitted onto a non-rotating member; and a rotating part arranged on the hollow spindle, wherein the inlet channel for supplying hydraulic fluid to the closing chamber is arranged such that said hydraulic fluid is in thermal contact with the interface between the stationary part and the rotating part of the mechanical seal when said hydraulic fluid is being supplied to said closing chamber.

4. The centrifugal separator according to claim 2, wherein said at least one hermetic seal is a seal that seals against said duct arranged to be through-flown by process medium during operation of the centrifugal separator.

5. The centrifugal separator according to claim 1, wherein said at least one hermetic seal is a seal that seals against said duct arranged to be through-flown by process medium during operation of the centrifugal separator.

6. The centrifugal separator according to claim 5, wherein the mechanical seal comprises:

a stationary part arranged to be fitted onto a non-rotating member; and a rotating part arranged on the hollow spindle, wherein the inlet channel for supplying hydraulic fluid to the closing chamber is arranged such that said hydraulic fluid is in thermal contact with the interface between the stationary part and the rotating part of the mechanical seal when said hydraulic fluid is being supplied to said closing chamber.

7. The centrifugal separator according to claim 1, wherein the separator comprises:

a first hermetic seal at said second end of the spindle, the first hermetic seal being arranged for sealing against a first stationary pipe that is in fluid contact with said duct of the hollow spindle that is arranged to be through-flown by process medium during operation; and a second seal for sealing against a second stationary pipe arranged for supplying said hydraulic fluid to said inlet channel of the hollow spindle.

8. The centrifugal separator according to claim 7, wherein the second seal is a second hermetic seal.

9. The centrifugal separator according to claim 8, wherein said inlet channel for supplying hydraulic fluid to said closing chamber is arranged such that said hydraulic fluid is in thermal contact with said first hermetic seal and said second hermetic seal when said hydraulic fluid is being supplied to said closing chamber.

10. The centrifugal separator according to claim 1, wherein the inlet channel for supplying hydraulic fluid is arranged in the hollow spindle as an annular space surrounding said duct arranged to be through-flown by process medium during operation of the centrifugal separator.

11. The centrifugal separator according to claim 1, wherein the inlet channel for supplying hydraulic fluid is arranged in the hollow spindle as a pipe extending in said duct arranged to be through-flown by process medium during operation of the centrifugal separator for feeding the fluid mixture into said separation space.

12. The centrifugal separator according to claim 1, further comprising a pressure generator arranged for supplying said hydraulic fluid under a pressure that is higher than atmospheric pressure.

13. The centrifugal separator according to claim 1, wherein said duct arranged to be through-flown by process medium during operation of the centrifugal separator is a duct for the fluid mixture that is to be separated.

14. The centrifugal separator according to claim 1, wherein said duct arranged to be through-flown by process medium during operation of the centrifugal separator is a duct for a separated liquid phase.

15. The centrifugal separator according to claim 1, further comprising a duct through the rotor casing for supply of liquid to open at least one outlet passage through which the hydraulic fluid of the closing chamber is drained, thereby initiating moving of the sliding bowl bottom to the open position.

16. The centrifugal separator according to claim 1, further comprising means that facilitates a continuous consumption of the hydraulic fluid or a circulation of the hydraulic fluid to a heat exchange unit.

17. A method for separation of at least two components of a fluid mixture which are of different densities, said method comprising the steps of:

providing the centrifugal separator according to claim 1;

supplying hydraulic fluid into the inlet channel to the closing chamber between the sliding bowl bottom and the rotor casing in order to hold the sliding bowl bottom in the closed position; and feeding the fluid mixture to be separated to the separation space of the centrifuge rotor via the duct arranged to be through-flown by process medium during operation of the centrifugal separator.

18. The method according to claim 17, wherein the hydraulic fluid is water.

19. The method according to claim 17, wherein the hydraulic fluid is supplied under pressure via the second end of the spindle.

20. The centrifugal separator according to claim 1, wherein the centrifuge rotor is mounted on a top of the hollow spindle and the duct extends from a bottom of the hollow spindle through the hollow spindle.

* * * * *